US011035541B2

(12) United States Patent
Sato

(10) Patent No.: US 11,035,541 B2
(45) Date of Patent: Jun. 15, 2021

(54) VEHICULAR LAMP UNIT AND VEHICULAR LAMP

(71) Applicant: STANLEY ELECTRIC CO., LTD., Tokyo (JP)

(72) Inventor: Takashi Sato, Tokyo (JP)

(73) Assignee: STANLEY ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 16/773,931

(22) Filed: Jan. 27, 2020

(65) Prior Publication Data

US 2020/0240606 A1 Jul. 30, 2020

(30) Foreign Application Priority Data

Jan. 29, 2019 (JP) ..... JP2019-013542

(51) Int. Cl.

| | |
|---|---|
| ***F21S 41/39*** | (2018.01) |
| ***F21S 45/47*** | (2018.01) |
| ***F21S 45/49*** | (2018.01) |
| ***F21S 41/37*** | (2018.01) |
| ***F21S 41/148*** | (2018.01) |
| ***F21S 41/33*** | (2018.01) |
| *F21Y 115/10* | (2016.01) |

(52) U.S. Cl.

CPC ..... *F21S 41/39* (2018.01); *F21S 41/148* (2018.01); *F21S 41/337* (2018.01); *F21S 41/37* (2018.01); *F21S 45/47* (2018.01); *F21S 45/49* (2018.01); *F21Y 2115/10* (2016.08)

(58) Field of Classification Search

None

See application file for complete search history.

(56) References Cited

U.S. PATENT DOCUMENTS

| | | | | |
|---|---|---|---|---|
| 2016/0356447 | A1* | 12/2016 | Yamamoto | F21S 41/39 |
| 2017/0030547 | A1* | 2/2017 | Yasuda | F21S 45/49 |
| 2017/0248287 | A1* | 8/2017 | Yasuda | F21S 41/192 |
| 2018/0128444 | A1* | 5/2018 | Suemitsu | F21S 45/47 |

FOREIGN PATENT DOCUMENTS

| | | | |
|---|---|---|---|
| JP | 2018-137125 | A | 8/2018 |

* cited by examiner

*Primary Examiner* — Elmito Breval

(74) *Attorney, Agent, or Firm* — Kenealy Vaidya LLP

(57) ABSTRACT

A vehicular lamp unit includes: a substrate on which a light source is mounted; a reflector including a substrate fixing portion and a reflector main body; and a screw. The substrate includes a first through hole, into which the screw is inserted; the substrate fixing portion includes a boss portion into which the screw is screwed; the reflector main body includes a base end portion fixed to the substrate fixing portion and a reflective surface to reflect light from the light source; the substrate is fixed to the substrate fixing portion in a state in which the substrate is held between the screw and the substrate fixing portion by screwing the screw, inserted into the first through hole, into the boss portion; and the substrate fixing portion includes at least one second through hole formed between the base end portion of the reflector main body and the boss portion.

15 Claims, 12 Drawing Sheets

VEHICULAR LAMP UNIT AND VEHICULAR LAMP

This application claims the priority benefit under 35 U.S.C. § 119 of Japanese Patent Application No. 2019-013542 filed on Jan. 29, 2019, which is hereby incorporated in its entirety by reference.

TECHNICAL FIELD

The presently disclosed subject matter relates to a vehicular lamp, and more particularly, to a vehicular lamp unit and a vehicular lamp capable of obtaining light distribution characteristics as designed.

BACKGROUND ART

Conventionally, in the field of vehicular lamps, there has been known a vehicular lamp comprising a substrate on which a light source is mounted, and a reflector in which a substrate fixing portion and a reflector main body are integrally molded, and having a structure in which the substrate is fixed to the reflector (the substrate fixing portion) by screwing a screw inserted into a through hole formed in the substrate to a boss portion (a thick portion protruding from the substrate fixing portion, or a screw boss) provided in the substrate fixing portion (for example, refer to Japanese Patent Application Laid-Open No. 2018-137125 A (FIG. 2 and the like)).

However, the present inventor has investigated and found that the above-mentioned conventional vehicular lamp cannot obtain light distribution characteristics as designed. This is considered to be caused by deformation of the reflector (reflective surface) due to stress generated by deformation of the boss portion due to screwing of the screw because the rigidity of the reflector is lower than that of the substrate.

SUMMARY

The presently disclosed subject matter was devised in view of these and other problems and features in association with the conventional art. According to an aspect of the presently disclosed subject matter, there can be provided a vehicular lamp unit and a vehicular lamp capable of obtaining light distribution characteristics as designed.

According to another aspect of the presently disclosed subject matter, a vehicular lamp unit includes: a substrate on which a light source is mounted; a reflector including a substrate fixing portion and a reflector main body that are integrally molded; and an engaging member. Herein, the substrate includes a first through hole formed therein, into which the engaging member is inserted; the substrate fixing portion includes an engaged portion with which the engaging member is engaged; the reflector main body includes a base end portion fixed to the substrate fixing portion and a reflective surface configured to reflect light emitted from the light source; the substrate is fixed to the substrate fixing portion in a state in which the substrate is held between the engaging member and the substrate fixing portion by engaging the engaging member, which has been inserted into the first through hole, into the engaged portion; and the substrate fixing portion includes at least one second through hole formed therein between the base end portion of the reflector main body and the engaged portion.

Herein, the engaging member may preferably be a screw and the engaged portion may preferably be a boss portion into which the screw is to be screwed. Further, it is preferable that, by screwing the screw into the boss portion, the substrate be fixed to the substrate fixing portion in a state in which the substrate is held between the head portion of the screw and the substrate fixing portion.

According to this aspect, it is possible to provide a vehicular lamp unit capable of obtaining light distribution characteristics as designed.

This is because the through hole is formed in the substrate fixing portion in a position between the base end portion of the reflector main body and the boss portion.

As a result, even when the substrate is fixed to the substrate fixing portion by screwing the screw, which has been inserted into the through hole formed in the substrate, into the boss portion provided in the substrate fixing portion, deformation of the reflector (reflective surface) is suppressed, so that light distribution characteristics as designed can be obtained.

In the aforementioned invention, a preferable mode is configured such that the rigidity of the reflector is lower than that of the substrate.

Further, in the aforementioned invention, a preferable mode is configured to further include a heat dissipation member and such that the heat dissipation member includes a third through hole formed therein into which the screw is inserted; the substrate is disposed between the heat dissipation member and the substrate fixing portion; and the substrate and the heat dissipation member are fixed to the substrate fixing portion in a state of being held between the head portion of the screw and the substrate fixing portion by screwing the screw, which has been inserted into the first through hole and the third through hole, into the boss portion.

In the aforementioned invention, a preferable mode is configured such that the rigidity of the reflector is lower than those of the substrate and the heat dissipation member.

In the aforementioned invention, a preferable mode is configured such that the heat dissipation member includes a heat dissipation fin.

Further, in the aforementioned invention, an alternative preferable mode is configured such that the heat dissipation member does not include a heat dissipation fin.

In the aforementioned invention, a preferable mode is configured such that the substrate fixing portion includes a positioning convex portion, the positioning convex portion is provided at a plurality of positions with the boss portion located therebetween, and the substrate is fixed to the substrate fixing portion in a state in which the positioning convex portion abuts against the substrate so that a gap is formed between the substrate and the substrate fixing portion.

In the aforementioned invention, a preferable mode is configured such that the substrate fixing portion includes a reinforcing rib portion that is provided between the second through hole and the boss portion.

In the aforementioned invention, a preferable mode is configured such that the reinforcing rib portion is provided along the second through hole.

According to still another aspect of the presently disclosed subject matter, a vehicular lamp includes a plurality of the vehicular lamp units according to any one of the foregoing aspect and modes.

BRIEF DESCRIPTION OF DRAWINGS

These and other characteristics, features, and advantages of the presently disclosed subject matter will become clear from the following description with reference to the accompanying drawings, wherein.

DESCRIPTION OF EXEMPLARY EMBODIMENTS

Figure 1:
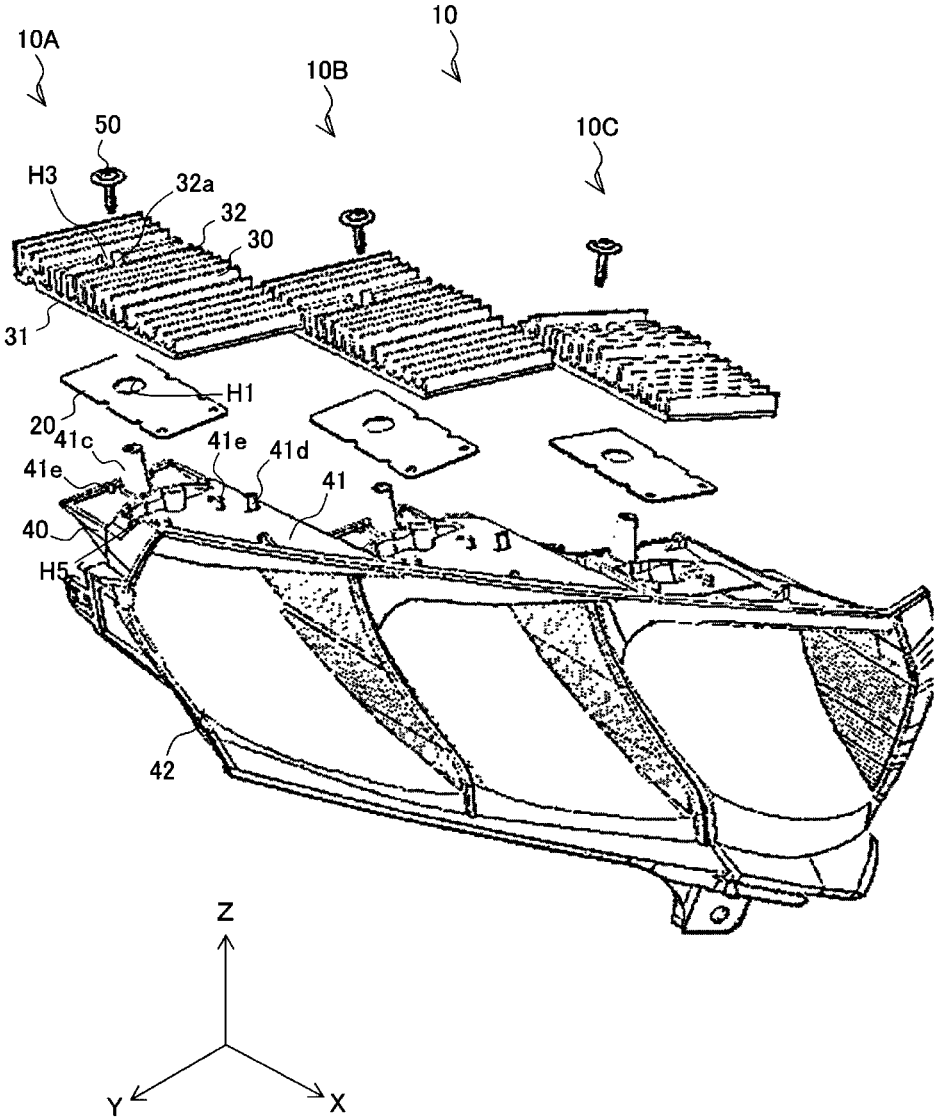
FIG. 1 is an exploded perspective view of a vehicular lamp 10 made in accordance with presently disclosed subject matter, as viewed from the front.

A description will now be made below to vehicular lamps 10 of the presently disclosed subject matter with reference to the accompanying drawings in accordance with exemplary embodiments. It should be noted that components corresponding to each other in the respective drawings are denoted by the same reference numerals, and repetitive descriptions thereof will be omitted.

Figure 2:
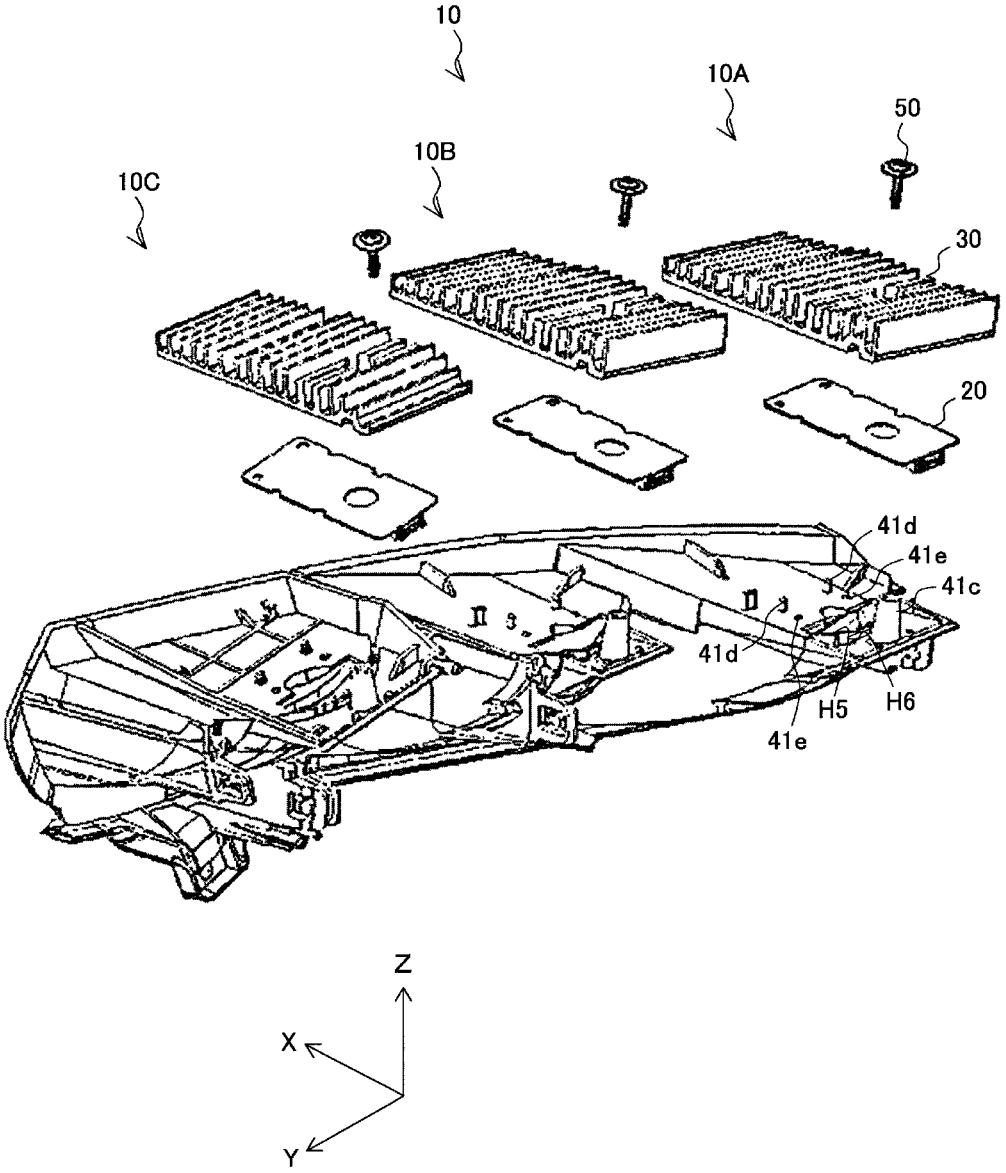
FIG. 2 is an exploded perspective view of the vehicular lamp 10 as viewed from the rear.
Figure 3:
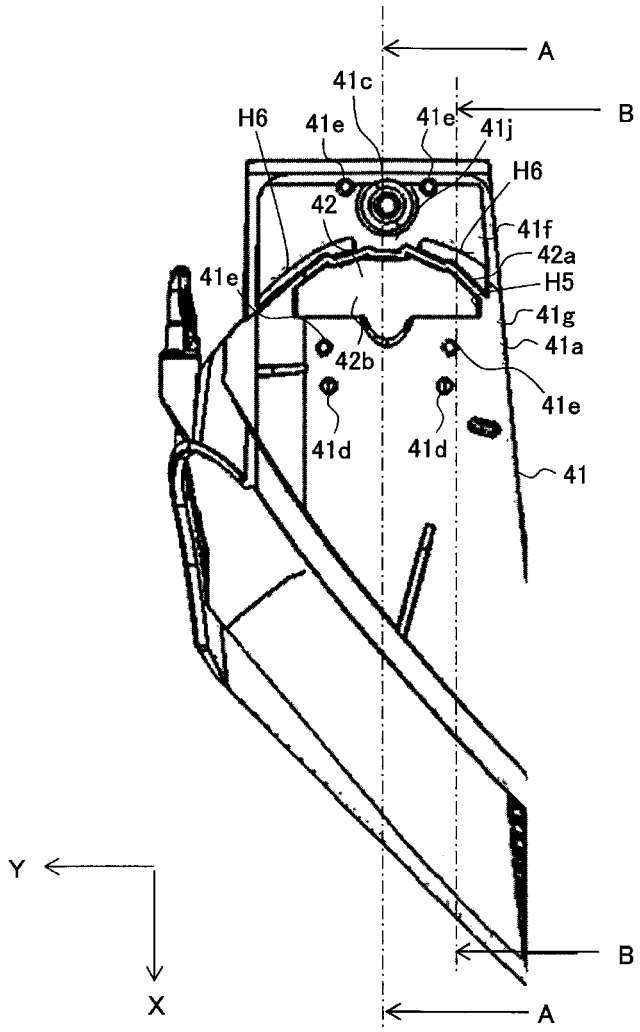
FIG. 3 is a top view of a vehicular lamp unit 10A of the vehicular lamp 10 while omitting a substrate 20 and a heat dissipation member 30.
Figure 4A:
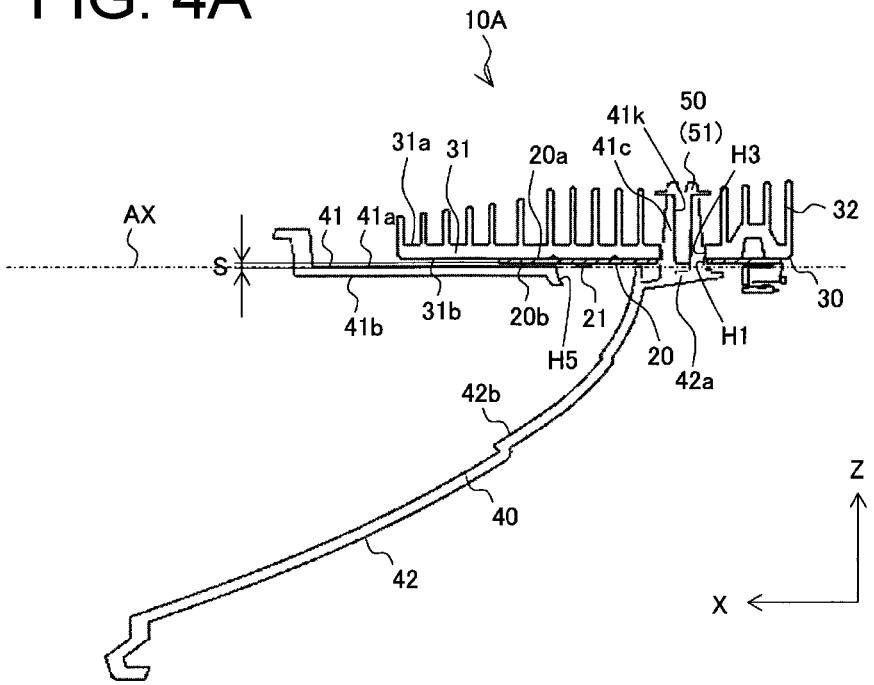
FIG. 4A is a cross-sectional view taken along line A-A of FIG. 3.
Figure 4B:
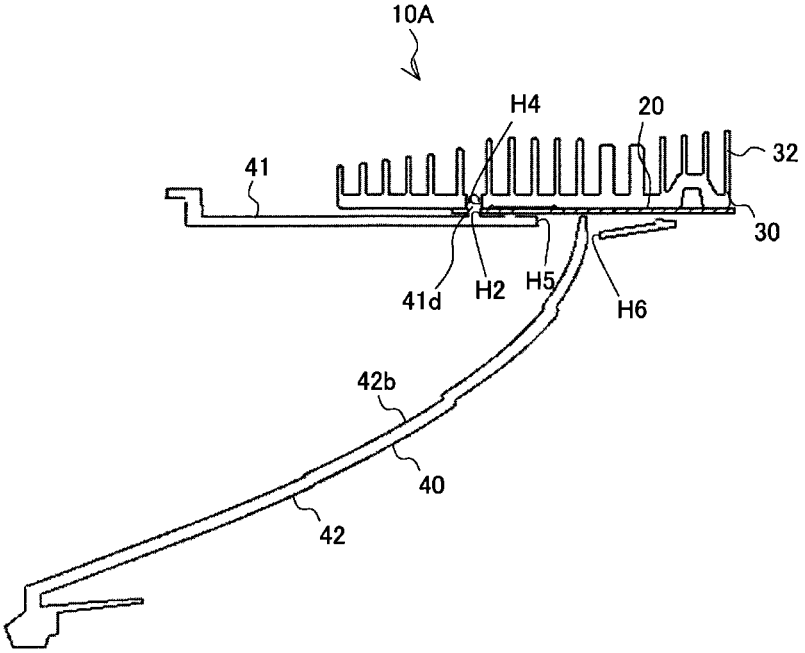
FIG. 4B is a cross-sectional view taken along line B-B of FIG. 3.

FIG. 1 is an exploded perspective view of a vehicular lamp 10 as viewed from the front, FIG. 2 is an exploded perspective view of the vehicular lamp 10 as viewed from the rear, FIG. 3 is a top view of a vehicular lamp unit 10A of the vehicular lamp 10 while omitting a substrate 20 and a heat dissipation member 30, FIG. 4A is a cross-sectional view taken along line A-A of FIG. 3, and FIG. 4B is a cross-sectional view taken along line B-B of FIG. 3.

The vehicular lamp 10 shown in FIGS. 1 to 4B is a vehicular headlamp capable of forming a light distribution pattern for a low beam or a light distribution pattern for a high beam, and is to be mounted on left and right sides of a front end portion of a vehicle (not shown). The light distribution pattern for a low beam or the light distribution pattern for a high beam is assumed to be formed on an imaginary vertical screen facing the front surface of the vehicle, which is assumed to be disposed about 25 m forward from the front surface of the vehicle.

Since the vehicular lamps 10 mounted on both the left and right sides have a symmetrical configuration, the vehicular lamp 10 mounted on the right side (right side toward the front of the vehicle) of the front end portion of the vehicle (not shown) will be described below as a representative. Hereinafter, for convenience of description, the XYZ axes will be defined. The X-axis extends in the front-rear direction of the vehicle, the Y-axis extends in the vehicle width direction, and the Z-axis extends in the vertical direction.

As shown in FIG. 1, the vehicular lamp 10 can include three vehicular lamp units 10A, 10B, and 10C. Hereinafter, the vehicular lamp units 10A, 10B, and 10C are simply referred to as lamp units 10A, 10B, and 10C. The lamp units 10A and 10B are each a lamp unit for a low beam. On the other hand, the lamp unit 10C is a lamp unit for a high beam. Since the lamp units 10A and 10B for a low beam and the lamp unit 10C for a high beam have the same configuration except for the different reflective surface, the lamp unit 10A for a low beam will be described below as a representative.

As shown in FIGS. 4A and 4B, the lamp unit 10A includes a substrate 20 on which a light source 21 is mounted, a heat dissipation member 30, a reflector 40, and a screw 50. The lamp unit 10A is disposed in a lamp chamber constituted by an outer lens and a housing, which are not illustrated, and is fixed to the housing or the like.

The substrate 20 is a substrate made of metal such as aluminum and includes an upper surface 20*a* and an opposite lower surface 20*b*.

Specifically, the light source 21 is mounted on the lower surface 20*b* of the substrate 20, and emits light downward. The light source 21 is, for example, a semiconductor light emitting element such as an LED that emits white light.

A through hole H1 (an example of the first through hole according to the presently disclosed subject matter) into which a boss portion 41*c* (an example of the engaged portion according to the presently disclosed subject matter) provided in the reflector 40 (and a screw 50 (an example of the engaging member according to the presently disclosed subject matter)) is to be inserted and a through hole H2 into which a positioning pin 41*d* (see FIG. 4B) provided in the reflector 40 is to be inserted are formed in the substrate 20. Each of the through holes H1 and H2 penetrates the substrate 20 from the upper surface 20*a* to the lower surface 20*b* thereof.

The heat dissipation member 30 is a member (heat sink) configured to radiate heat generated by the light source 21 for cooling, and includes a base portion 31 and heat dissipation fins 32. The heat dissipation member 30 is a metal member such as aluminum die casting, for example.

The base portion 31 includes an upper surface 31*a* and an opposite lower surface 31*b*. The heat dissipation fins 32 are provided on the upper surface 31*a* of the base portion 31.

A through hole H3 (an example of the third through hole according to the presently disclosed subject matter) into which the boss portion 41*c* provided in the reflector 40 (and the screw 50) is to be inserted and a through hole H4 into which the positioning pin 41*d* (see FIG. 4B) provided in the reflector 40 is to be inserted are formed in the heat dissipation member 30 (base portion 31). Each of the through holes H3 and H4 penetrates the base portion 31 from the upper surface 31*a* to the lower surface 31*b* thereof. A notch 32*a* (see FIG. 1) is formed in a part of the heat dissipation fins 32 so that the boss portion 41*c* inserted into the through hole H3 does not interfere therewith.

The reflector 40 includes a substrate fixing portion 41 (ceiling surface) and a reflector main body 42. The reflector 40 is made of a synthetic resin such as a polycarbonate resin and integrally molded by injection molding of a synthetic resin such as a polycarbonate resin.

The substrate fixing portion 41 includes an upper surface 41*a* and an opposite lower surface 41*b*. The upper surface 41*a* is a plane substantially parallel to the XY plane.

The reflector main body 42 includes a base end portion 42*a* continued to the substrate fixing portion 41 (lower surface 41*b*) and a reflective surface 42*b* configured to reflect light emitted from the light source 21.

The reflective surface 42*b* is formed by performing metal vapor deposition such as aluminum vapor deposition on the front surface of the reflector main body 42. When the reflector 40 is made of a polycarbonate resin, there is an advantage that metal can be directly deposited on the reflector 40 without applying an undercoat.

The reflective surface 42*b* is a reflective surface based on a paraboloid, and includes a plurality of rectangular reflective regions (not shown) partitioned in a lattice shape by a horizontal plane and a vertical plane (so-called multi-reflector). The light source 21 is disposed in the vicinity of the focal point of the reflective surface 42*b*. The surface shape of each reflective region is designed so that light from the light source 21 reflected by the reflective region and irradiated forward forms a light distribution pattern for a low beam. The symbol AX in FIG. 4A is an optical axis of the lamp unit 10A, passes through the focal point of the reflective surface 42*b*, and extends in the X direction.

As shown in FIG. 3, the substrate fixing portion 41 includes, on its upper surface 41*a*, the boss portion 41*c* or a screw boss, the positioning pin 41*d*, and a positioning convex portion 41*e*.

The boss portion 41*c* is provided on the upper surface 41*a* of the substrate fixing portion 41 rearward of the base end portion 42*a* of the reflector main body 42 (upward in FIG. 3). The boss portion 41*c* is formed in a truncated conical shape having a diameter decreasing upward (see FIG. 1 and FIG. 4A). A screw hole 41*k* into which the screw 50 is to be screwed is formed in the boss portion 41*c* (see FIG. 4A). The screw hole 41*k* extends in the Z direction from the distal end surface of the boss portion 41*c*.

The positioning pins 41*d* are provided at appropriate positions on the upper surface 41*a* of the substrate fixing portion 41, for example, at two positions in FIG. 3.

The positioning convex portions 41*e* are provided at a plurality of positions of the upper surface 41*a* of the substrate fixing portion 41 with the boss portion 41*c* located therebetween. For example, the positioning convex portions 41*e* are provided at positions (two positions in FIG. 3 are illustrated) rearward (upward in FIG. 3) of the boss portion 41*c* and at positions (two positions in FIG. 3 are illustrated) forward (downward in FIG. 3) of the boss portion 41C on the upper surface 41*a* of the substrate fixing portion 41, respectively. The distal end surface of the positioning convex portion 41*e* is a flat plane substantially parallel to the XY plane. The positioning convex portions 41*e* may be omitted in some cases.

Figure 5A:
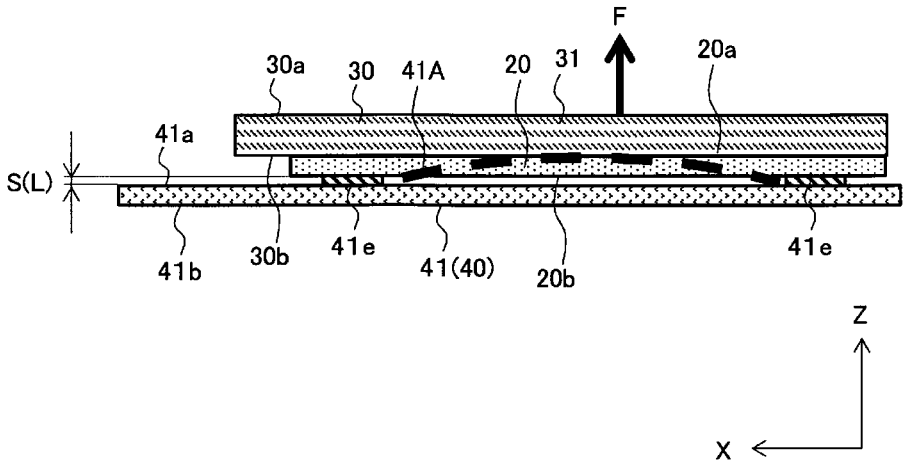
FIG. 5A Conventional Art
FIGS. 5A and 5B are each a simplified diagram, which corresponds to a vertical cross-sectional view, for illustrating the action of a positioning convex portion 41*e;*
Figure 5B:
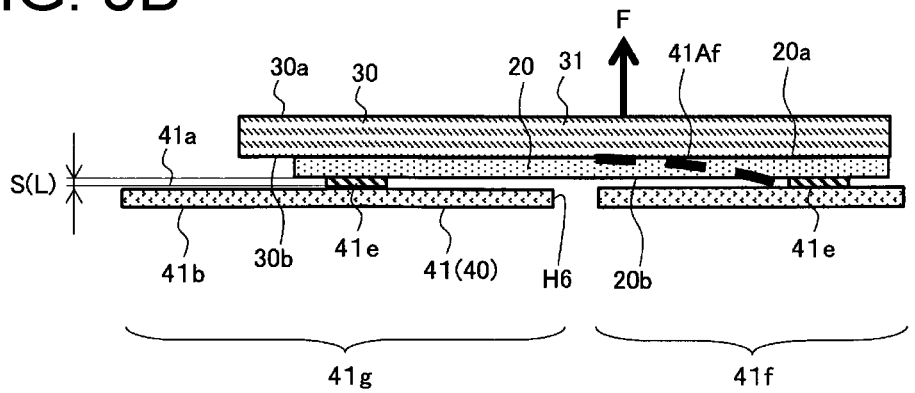

FIGS. 5A and 5B are each a simplified diagram, which corresponds to a vertical cross-sectional view, for illustrating the action of the positioning convex portion 41*e*. For convenience of explanation, the boss portion 41*c*, the screw 50, and the like are omitted in FIG. 5. For convenience of explanation, in FIG. 5, the substrate 20, the heat dissipation member 30, and the reflector 40 including the substrate fixing portion 41 are illustrated in a simplified manner.

As shown in FIG. 5A, when the positioning convex portion 41*e* abuts against the substrate 20 (against the lower surface 20*b* thereof), a gap S is formed between the lower surface 20*b* of the substrate 20 and the upper surface 41*a* of the substrate fixing portion 41 of the reflector 40.

The length L of the positioning convex portion 41*e* in the Z direction may be any length as long as a gap S is formed between the lower surface 20*b* of the substrate 20 and the upper surface 41*a* of the substrate fixing portion 41 of the reflector 40, and is, for example, several millimeters.

As shown in FIGS. 3 to 4B, a through hole H5 is formed in the substrate fixing portion 41 to allow the light from the light source 21 mounted on the substrate 20 to pass therethrough. The through hole H5 penetrates the substrate fixing portion 41 from the upper surface 41*a* to the lower surface 41*b* thereof. The through hole H5 is formed forward of the base end portion 42*a* of the reflector main body 42.

The substrate 20 having the above-described configuration is disposed with its lower surface 20*b* facing the upper surface 41*a* of the substrate fixing portion 41 of the reflector 40, as shown in FIGS. 4A and 4B.

At this time, the boss portion 41*c* provided in the reflector 40 is inserted into the through hole H1 formed in the substrate 20. At the same time, the positioning pin 41*d* provided in the reflector 40 is inserted into the through hole H2 formed in the substrate 20. As a result, the substrate 20 is positioned in the XY direction.

Further, as shown in FIG. 5A, the positioning convex portion 41*e* provided in the reflector 40 abuts against the lower surface 20*b* of the substrate 20 at the tip surface thereof. As a result, the substrate 20 is positioned in the Z direction.

At this time, since the gap S is formed between the lower surface 20*b* of the substrate 20 and the upper surface 41*a* of the substrate fixing portion 41 of the reflector 40, the lower surface 20*b* of the substrate 20 and the upper surface 41*a* of the substrate fixing portion 41 of the reflector 40 do not come into contact with each other. Thus, regardless of the state of the upper surface 41*a* of the substrate fixing portion 41 of the reflector 40, for example, even when the upper surface 41*a* of the substrate fixing portion 41 of the reflector 40 is not flat but distorted, the substrate 20 can be accurately positioned in the Z direction.

As a result of the positioning of the substrate 20 in the XYZ directions as described above, the light source 21 is accurately disposed in the vicinity of the focal point of the reflector 40.

On the other hand, the heat dissipation member 30 having the above-described configuration is disposed in a state in which the lower surface 31*b* is in contact with the upper surface 20*a* of the substrate 20, as shown in FIGS. 4A and 4B.

At this time, the boss portion 41*c* inserted into the through hole H1 formed in the substrate 20 is inserted into the through hole H3 formed in the heat dissipation member 30 (see FIG. 4A). At the same time, the positioning pin 41*d* inserted into the through hole H2 formed in the substrate 20 is inserted into the through hole H4 formed in the heat dissipation member 30 (see FIG. 4B). As a result, the heat dissipation member 30 is positioned in the XY direction.

Although not shown, it is preferable to dispose a heat conduction member between the upper surface 20*a* of the substrate 20 and the lower surface 31*b* of the heat dissipation member 30 from the viewpoint of enhancing heat conductivity between the substrate 20 (light source 21) and the heat dissipation member 30. The heat conduction member is, for example, a thermal grease or a heat conduction sheet.

Then, the screw 50 is screwed into the boss portion 41*c* inserted into the through holes H1 formed in the substrate 20 and the through holes H3 formed in the heat dissipation member 30 as described above (for example, screwed clockwise), whereby the substrate 20 and the heat dissipation member 30 are fixed to the substrate fixing portion 41 in a state of being held between the head portion 51 of the screw 50 and the positioning convex portion 41*e* of the substrate fixing portion 41 (see FIG. 4A).

In the lamp unit 10A having the above configuration, when the light source 21 is turned on, light from the light source 21 passes through the through hole H5 and is reflected by the reflective surface 42*b*, and then is irradiated forward to form a light distribution pattern for a low beam.

Figure 6:
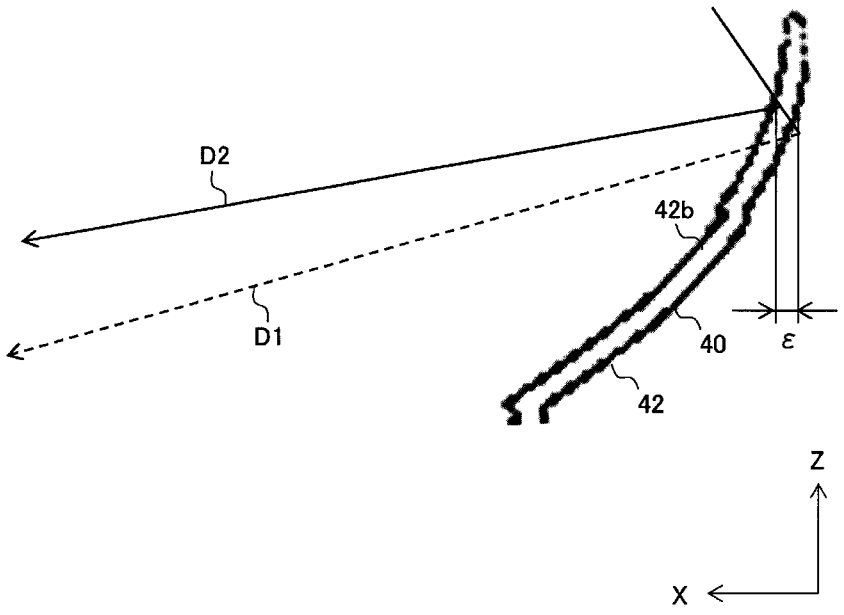
FIG. 6 is a diagram for illustrating that light reflected from a reflective surface 42*b* is irradiated in a direction D2 different from a target direction D1.

FIG. 6 is a diagram for illustrating that the reflected light from the reflective surface 42*b* is irradiated in a direction D2 different from a target direction D1.

As a result of examination by the present inventor, it has been found that in a lamp unit having the similar configuration described heretofore without a through hole H6, the reflector 40 (the reflective surface 42*b*) is distorted (deformed from the designed shape) as illustrated in FIG. 6, and as a result, the reflected light from the reflective surface 42*b* is irradiated in the direction D2 different from the target direction D1, and thus the light distribution characteristic as designed cannot be obtained. The symbol ε in FIG. 6 represents the distortion amount.

The reason why the reflective surface 42*b* of the reflector 40 is distorted can be considered as follows.

That is, since the rigidity of the reflector 40 made of a synthetic resin is lower than that of the substrate 20 and the heat dissipation member 30 both made of metal, the boss portion 41*c* is compressed and deformed in the Z direction in accordance with the screwing of the screw 50. The substrate 20 and the heat dissipation member 30 are relatively firmly held between the head portion 51 of the screw 50 and the substrate fixing portion 41 (positioning convex portion 41*e*) by the repulsive force (or restoring force) of the deformed boss portion 41*c*.

At this time, a stress (hereinafter, referred to as a first stress) generated by the repulsive force of the boss portion 41*c* acts on the reflector 40 (reflective surface 42*b*). As a result, it is considered that the reflector 40 (the reflective surface 42*b*) is distorted.

The following can also be considered.

That is, when the boss portion 41*c* deforms as described above, the upward force F in the Z direction acts on the substrate fixing portion 41 (see FIG. 5A). At this time, since the gap S is formed between the lower surface 20*b* of the substrate 20 and the upper surface 41*a* of the substrate fixing portion 41 of the reflector 40, the substrate fixing portion 41 bends upward in a convex arc shape with the positioning convex portion 41*e* as a fulcrum by the force F upward in the Z direction (see a dotted line indicated by reference numeral 41A in FIG. 5A). A stress (hereinafter, referred to as a second stress) generated by the deflection of the substrate fixing portion 41 acts on the reflector 40 (the reflective surface 42*b*). As a result, it is considered that the reflector 40 (the reflective surface 42*b*) is distorted.

It is also considered that both of the first stress and the second stress act on the reflector 40 (the reflective surface 42*b*), and as a result, the reflector 40 (the reflective surface 42*b*) is distorted.

The present inventor has intensively investigated in order to obtain light distribution characteristics as designed. As a result, as shown in FIG. 3 and FIG. 4B, the present inventor has found that the light distribution characteristic as designed can be obtained by forming a through hole H6 (an example of the second through hole according to the presently disclosed subject matter) in a position between the base end portion 42*a* of the reflector main body 42 and the boss portion 41*c* of the substrate fixing portion 41.

This is considered to be because, when the through-hole H6 is formed, at least one of the first stress and the second stress acts on only a rear portion 41*f* (see FIG. 5B) of the substrate fixing portion 41 with the through hole H6 as a boundary, so that only the rear portion 41*f* bends and a front portion 41*g* does not bend, as indicated by a dotted line 41Af in FIG. 5B.

Figure 7A:
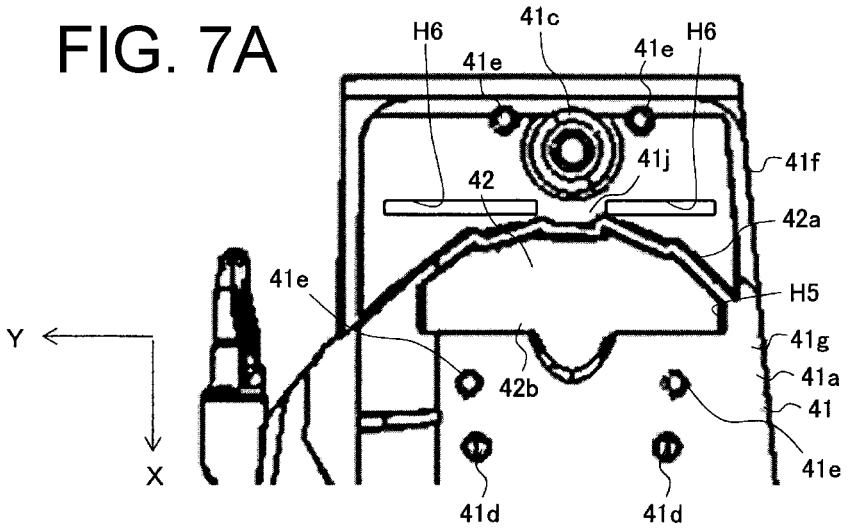
FIGS. 7A, 7B, and 7C are each a diagram illustrating an example or a modified example of a through hole H6.
Figure 7B:
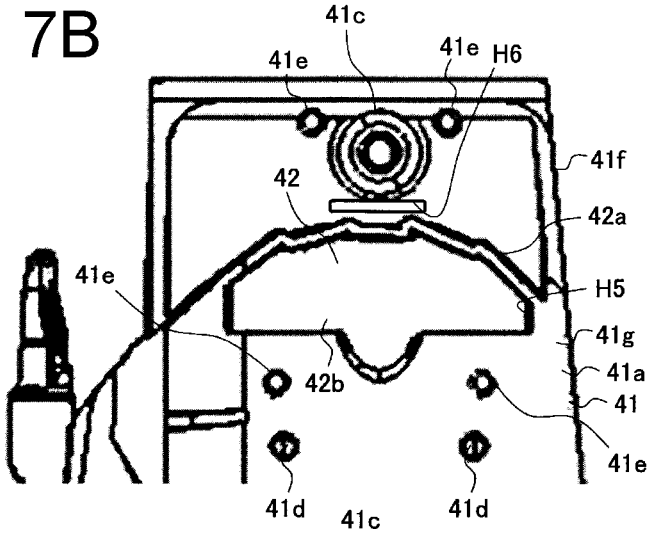
Figure 7C:
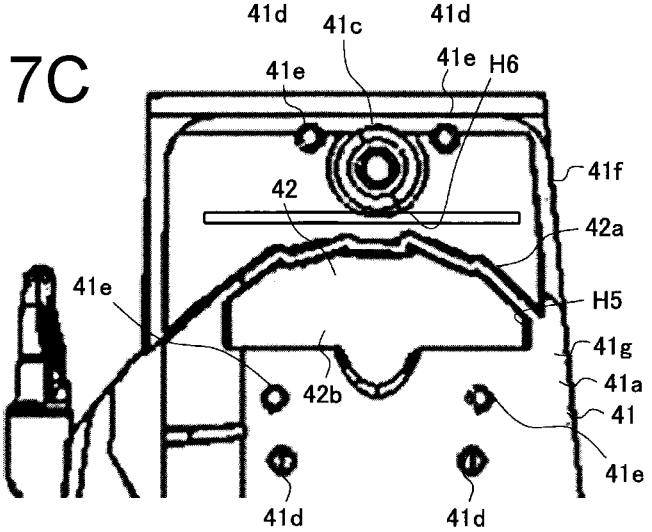
Figure 8:
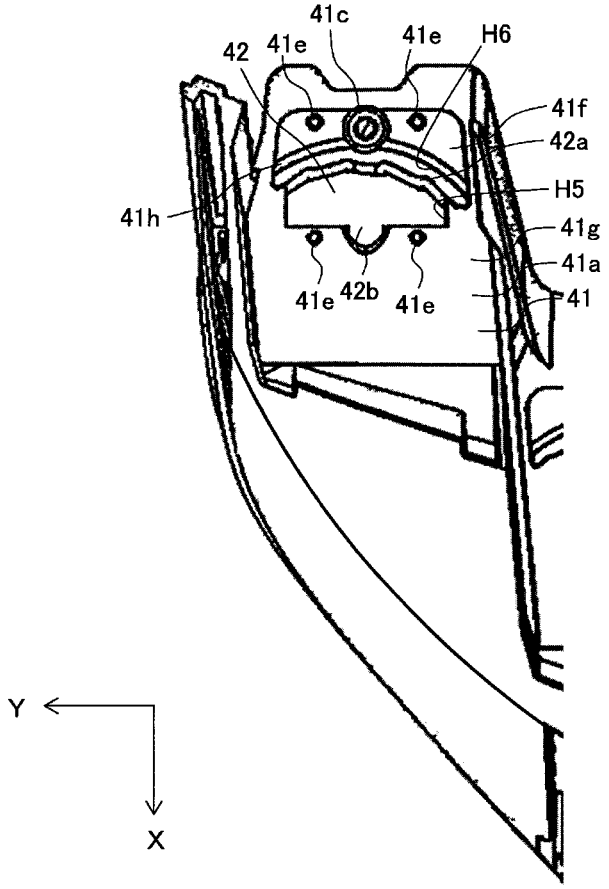
FIG. 8 is a diagram illustrating a modified example of the through hole H6.

FIGS. 7A to 8 show modified examples of the through hole H6.

The through hole H6 penetrates the substrate fixing portion 41 from the upper surface 41*a* to the lower surface 41*b*. The through hole H6 may have any shape as long as it is formed in a position between the base end portion 42*a* of the reflector main body 42 and the boss portion 41*c* (see FIG. 3 and FIG. 4B).

For example, the through hole H6 may have a shape curved along the base end portion 42*a* of the reflector main body 42 in a top view (see FIGS. 3 and 8) or may have a shape linearly extending in the Y direction (see FIGS. 7A to 7C). In addition, the through hole H6 may be separated by the connection portion 41*j* halfway (see FIG. 3 and FIG. 7A) or may not be separated (see FIG. 7B, FIG. 7C, and FIG. 8).

In addition, for example, a plurality of through holes H6 may be provided (see FIG. 3 and FIG. 7A) or a single through hole H6 may be provided (see FIG. 7B, FIG. 7C, and FIG. 8).

The through hole H6 is desirably set as long as possible in the Y direction (see FIGS. 3 and 7C), but may be set short (see FIG. 7B).

Figure 9:
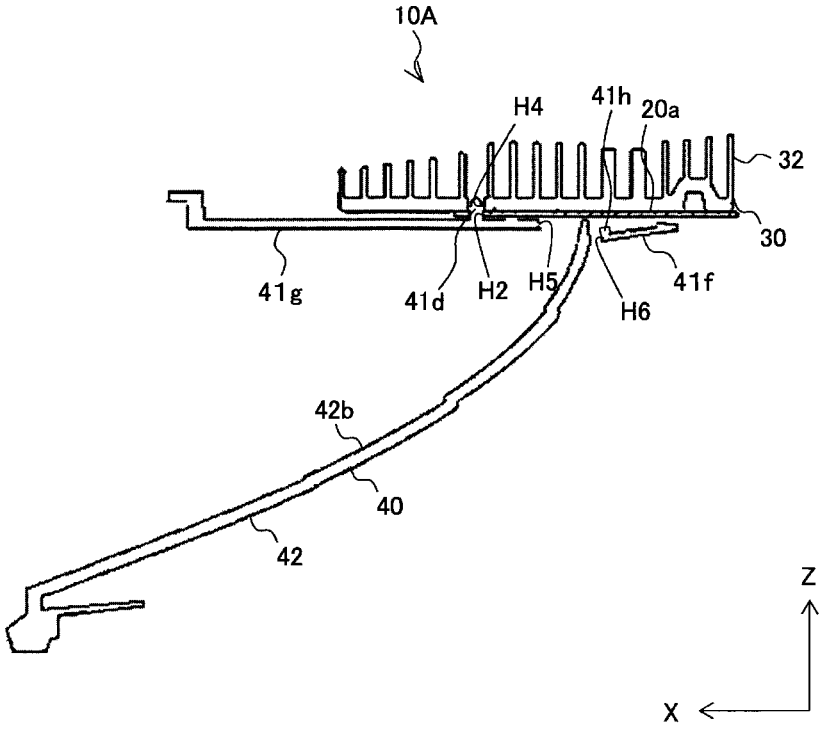
FIG. 9 is a diagram illustrating an example of a reinforcing rib 41*h;*

In order to suppress deformation of the rear portion 41*f* by at least one of the first stress and the second stress acting on the rear portion 41*f*, it is desirable to provide a reinforcing rib 41*h* in the rear portion 41*f* as shown in FIGS. 8 and 9. The reinforcing rib 41*h* may preferably be provided between the through hole H6 and the boss portion 41*c*, and in particular, may preferably be provided in a curved state along the through hole H6 like that in FIG. 8.

As described above, according to the present embodiment, it is possible to provide the vehicular lamp unit 10A and the vehicular lamp 10 capable of obtaining the light distribution characteristics as designed.

This is because the through hole H6 is formed in a position between the base end portion 42*a* of the reflector main body 42 and the boss portion 41*c* of the substrate fixing portion 41.

As a result, even when the substrate 20 is fixed to the reflector 40 (substrate fixing portion 41) by screwing the screw 50, inserted into the through hole H1 formed in the substrate 20, into the boss portion 41*c* provided in the reflector 40 (substrate fixing portion 41), deformation of the reflector 40 (reflective surface 42*b*) is suppressed, so that light distribution characteristics as designed can be obtained.

In the foregoing embodiment, a screw is exemplified as the engaging member in the presently disclosed subject matter. In addition, a boss portion provided in the reflector is illustrated as an engaged portion to be engaged with the engaging member. The presently disclosed subject matter is not limited to these, and may include members configured to engage and fix the reflector with and to the substrate in the Z direction (thus causing compression deformation of the reflector). For example, in addition to screwing the screw into the boss portion, methods may be used in which an engaging member such as a grommet or a rivet may be inserted into an engaged portion such as an engaged hole formed in a boss or directly in a reflector and fixed by compression or caulking.

Next, a modified example will be described.

In the aforementioned embodiment, an example in which the vehicular lamp unit according to the presently disclosed subject matter is applied to a vehicular headlamp (a lamp unit for a low beam and a lamp unit for a high beam) has been described, but the presently disclosed subject matter is not limited thereto. For example, the vehicular lamp unit according to the presently disclosed subject matter may be applied to various vehicular lamps other than the vehicular headlamp, for example, a vehicular signal lamp.

Figure 10:
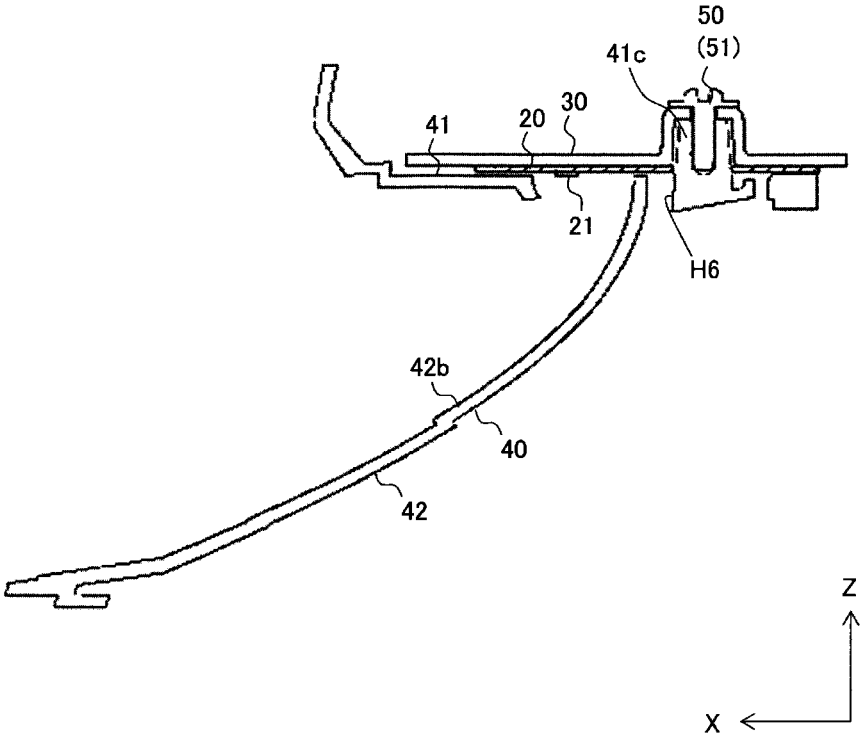
FIG. 10 is a diagram illustrating a modified example of a heat dissipation member 30.

FIG. 10 is a diagram illustrating a modified example of the heat dissipation member 30.

In the aforementioned embodiment, an example in which the heat dissipation member 30 including the heat dissipation fins 32 is used has been described, but the presently disclosed subject matter is not limited thereto. For example, as illustrated in FIG. 10, a heat dissipation member 30 that does not include any heat dissipation fins 32 may be used.

Figure 11:
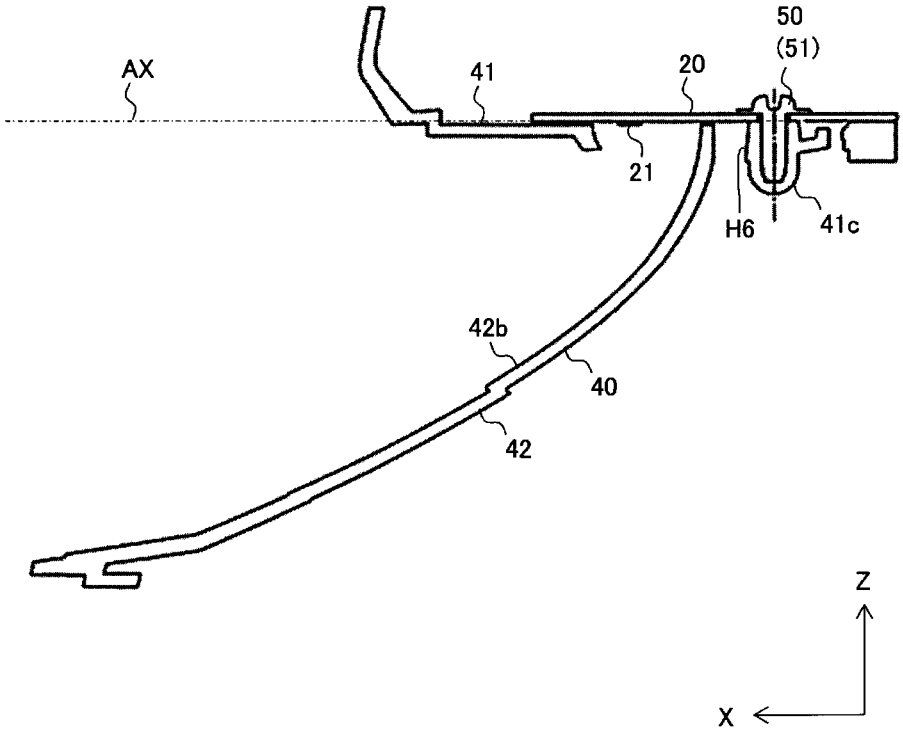
FIG. 11 is a diagram illustrating a modified example of the vehicular lamp unit 10A.

FIG. 11 is a diagram illustrating a modified example of the vehicular lamp unit 10A.

In the aforementioned embodiment, an example in which the heat dissipation member 30 is used has been described, but the presently disclosed subject matter is not limited thereto. For example, as illustrated in FIG. 11, the heat dissipation member 30 may be omitted.

Also in this case, since the rigidity of the reflector 40 made of a synthetic resin is lower than that of the substrate 20 made of metal, the boss portion 41*c* is compressed and deformed in the Z direction in accordance with the screwing of the screw 50. The substrate 20 is held between the head portion 51 of the screw 50 and the substrate fixing portion 41 (positioning convex portion 41*e*) by the repulsive force (or restoring force) of the deformed boss portion 41*c*.

According to the present modified example, similarly to the aforementioned embodiment, the formation of the through hole H6 in a position between the base end portion 42*a* of the reflector main body 42 and the boss portion 41*c* of the substrate fixing portion 41 can achieve the light distribution characteristic as designed.

Figure 12:
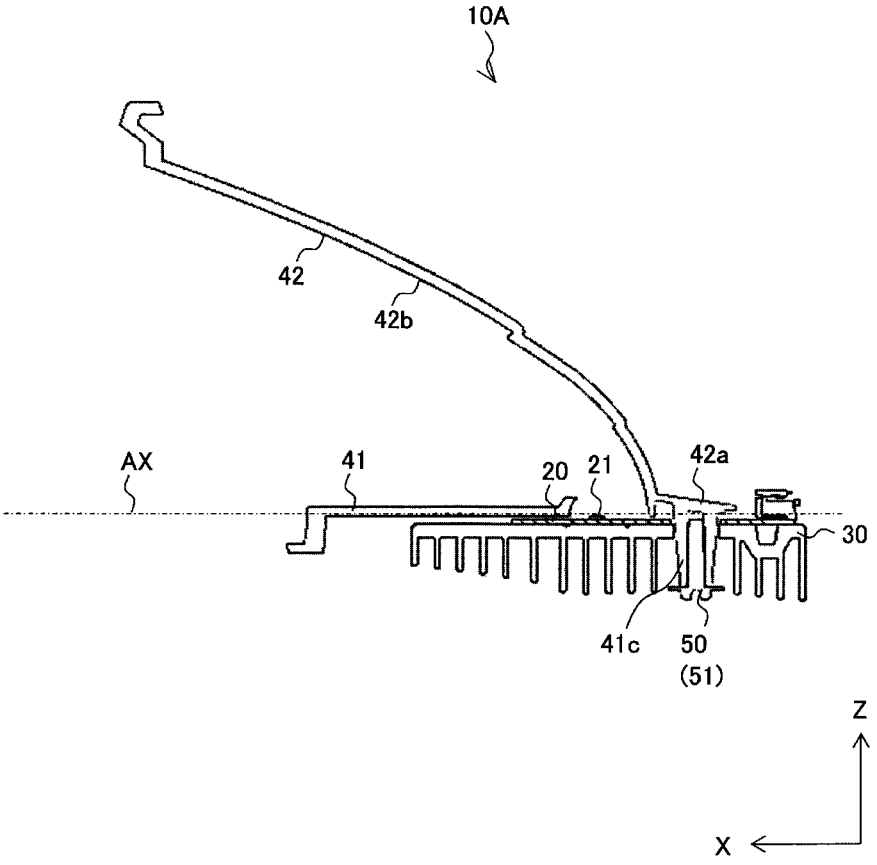
FIG. 12 is a diagram illustrating a modified example of the vehicular lamp unit 10A.

FIG. 12 is a diagram illustrating a modified example of the vehicular lamp unit 10A.

The lamp unit 10A may be disposed in a state of being rotated by a predetermined angle about the optical axis AX. For example, as shown in FIG. 12, the lamp unit 10A may be disposed in a state of being rotated by 90 degrees about the optical axis AX. Further, for example, although not illustrated, the lamp unit 10A may be disposed in a state of being rotated by 45 degrees about the optical axis AX.

Respective numerical values shown in the above embodiment and modified examples is merely an example, and it is a matter of course that an appropriate numerical value different from this can be used.

It will be apparent to those skilled in the art that various modifications and variations can be made in the presently disclosed subject matter without departing from the spirit or scope of the presently disclosed subject matter. Thus, it is intended that the presently disclosed subject matter cover the modifications and variations of the presently disclosed subject matter provided they come within the scope of the appended claims and their equivalents. All related art references described above are hereby incorporated in their entirety by reference.

What is claimed is:

1. A vehicular lamp unit comprising:

a plate-shaped substrate having a first surface and a second surface opposite to the first surface;

a light source mounted on the second surface;

a reflector including a substrate fixing portion and a reflector main body configured to reflect light emitted from the light source, the reflector being made of a synthetic resin, the substrate fixing portion and the reflector main body being integrally molded; and an engaging member, wherein the substrate includes a first through hole formed therein, into which the engaging member is inserted;

the substrate fixing portion includes a through hole that is formed therethrough and through which the light from the light source is allowed to pass toward the reflector main body, a boss portion, and a positioning member;

the reflector main body includes a base end portion fixed to one surface of the substrate fixing portion and a reflective surface configured to reflect light emitted from the light source, the reflective surface being formed as a reflective surface based on a paraboloid and extending from the base end portion;

the boss portion, which is integrally formed with the substrate fixing portion from the synthetic resin, extends in a vertical direction with respect to the substrate fixing portion at a position rearward of the base end portion of the reflector main body;

the positioning member includes an in-plane positioning member configured to position the substrate in a plane direction parallel to the substrate fixing portion, and a vertical positioning member configured to position the substrate in a direction perpendicular to the substrate fixing portion;

the vertical positioning member is formed to protrude from a second surface of the substrate fixing portion opposite to the one surface thereof, so as to abut against the second surface of the substrate and form a gap between the second surface of the substrate fixing portion and the second surface of the substrate;

the substrate is fixed to the substrate fixing portion in a state in which the substrate is held between the engaging member and the substrate fixing portion by engaging the engaging member, which has been inserted into the first through hole, into the boss portion;

the reflector has a rigidity lower than that of the substrate;

the substrate fixing portion includes at least one second through hole formed therein between the base end portion of the reflector main body and the boss portion; and the second through hole has an elongated shape in a vehicle width direction more than in a vehicle front-rear direction.

2. The vehicular lamp unit according to claim 1, wherein the engaging member is a screw and the engaged portion is a boss portion into which the screw is to be screwed, so that by screwing the screw into the boss portion, the substrate is fixed to the substrate fixing portion in a state in which the substrate is held between a head portion of the screw and the substrate fixing portion.

3. The vehicular lamp unit according to claim 2, further comprising a heat dissipation member and wherein the heat dissipation member includes a third through hole formed therein into which the screw is inserted;

the substrate is disposed between the heat dissipation member and the substrate fixing portion; and the substrate and the heat dissipation member are fixed to the substrate fixing portion in a state of being held between the head portion of the screw and the substrate fixing portion by screwing the screw, which has been inserted into the first through hole and the third through hole, into the boss portion.

4. The vehicular lamp unit according to claim 3, wherein a rigidity of the reflector is lower than those of the substrate and the heat dissipation member.

5. The vehicular lamp unit according to claim 3, wherein the heat dissipation member includes a heat dissipation fin.

6. The vehicular lamp unit according to claim 4, wherein the heat dissipation member includes a heat dissipation fin.

7. The vehicular lamp unit according to claim 3, wherein the heat dissipation member does not include a heat dissipation fin.

8. The vehicular lamp unit according to claim 4, wherein the heat dissipation member does not include a heat dissipation fin.

9. The vehicular lamp unit according to claim 2, wherein the substrate fixing portion includes a reinforcing rib portion that is provided between the second through hole and the boss portion.

10. The vehicular lamp unit according to claim 9, wherein the reinforcing rib portion is provided along the second through hole.

11. The vehicular lamp unit according to claim 2, wherein the through hole that is formed in the substrate fixing portion to allow the light from the light source to pass therethrough toward the reflector main body is formed forward of the base end portion of the reflector main body.

12. The vehicular lamp unit according to claim 11, wherein the vertical positioning member includes:

a forward vertical positioning member positioned forward of the through hole in the substrate fixing portion, and a rearward vertical positioning member positioned rearward of the base end portion of the reflector main body.

13. The vehicular lamp unit according to claim 11, wherein the second through hole has a shape in a top view selected from the group consisting of: a shape curved along the base end portion of the reflector main body; a shape linearly extending in a vehicle width direction; a shape including a plurality of curved separate holes along the base end portion of the reflector main body; and a shape including a plurality of linearly extending separate holes extending in the vehicle width direction.

14. A vehicular lamp comprising a plurality of the vehicular lamp units, vehicular lamp unit comprising:

a plate-shaped substrate having a first surface and a second surface opposite to the first surface;

a light source mounted on the second surface;

a reflector including a substrate fixing portion and a reflector main body configured to reflect light emitted from the light source, the reflector being made of a synthetic resin, the substrate fixing portion and the reflector main body being integrally molded; and a screw, wherein the substrate includes a first through hole formed therein, into which the screw is inserted;

the substrate fixing portion includes a through hole that is formed therethrough and through which the light from the light source is allowed to pass toward the reflector main body, a boss portion, and a positioning member;

the reflector main body includes a base end portion fixed to one surface of the substrate fixing portion and a reflective surface configured to reflect light emitted from the light source, the reflective surface being formed as a reflective surface based on a paraboloid and extending from the base end portion;

the boss portion, which is integrally formed with the substrate fixing portion from the synthetic resin, extends in a vertical direction with respect to the substrate fixing portion at a position rearward of the base end portion of the reflector main body;

the positioning member includes an in-plane positioning member configured to position the substrate in a plane direction parallel to the substrate fixing portion, and a vertical positioning member configured to position the substrate in a direction perpendicular to the substrate fixing portion;

the vertical positioning member is formed to protrude from a second surface of the substrate fixing portion opposite to the one surface thereof, so as to abut against the second surface of the substrate and form a gap between the second surface of the substrate fixing portion and the second surface of the substrate;

the substrate is fixed to the substrate fixing portion in a state in which the substrate is held between a head portion of the screw and the substrate fixing portion by screwing the screw, which has been inserted into the first through hole, into the boss portion;

the reflector has a rigidity lower than that of the substrate;

the substrate fixing portion includes at least one second through hole formed therein between the base end portion of the reflector main body and the boss portion; and the second through hole has an elongated shape in a vehicle width direction more than in a vehicle front-rear direction.

15. The vehicular lamp unit according to claim 14, wherein the second through hole has a shape in a top view selected from the group consisting of: a shape curved along the base end portion of the reflector main body; a shape linearly extending in a vehicle width direction; a shape including a plurality of curved separate holes along the base end portion of the reflector main body; and a shape including a plurality of linearly extending separate holes extending in the vehicle width direction.

* * * * *